US005263689A

United States Patent [19]

Menzies et al.

[11] Patent Number: 5,263,689

[45] Date of Patent: Nov. 23, 1993

[54] APPARATUS FOR MAKING ALLOY POWER

[75] Inventors: Richard G. Menzies, Wyoming; Joseph Hopkins, Maineville, both of Ohio; Joseph J. Jackson, Topsfield, Mass.; Richard W. Lober, Cincinnati, Ohio; David P. Mourer, Danvers, Mass.; Robert G. Zimmerman, Jr., Morrow, Ohio

[73] Assignee: General Electric Company, Cincinnati, Ohio

[21] Appl. No.: 833,881

[22] Filed: Feb. 11, 1992

Related U.S. Application Data

[63] Continuation-in-part of Ser. No. 549,669, Jul. 6, 1990, abandoned, which is a continuation of Ser. No. 420,706, Oct. 11, 1989, abandoned, which is a continuation of Ser. No. 287,673, Dec. 20, 1988, abandoned, which is a continuation of Ser. No. 150,477, Jan. 28, 1988, abandoned, which is a continuation of Ser. No. 738,495, May 28, 1985, abandoned, which is a continuation of Ser. No. 507,255, Jun. 23, 1983, abandoned.

[51] Int. Cl.[5] ..... C21D 11/00

[52] U.S. Cl. ..... 266/80; 266/87; 266/94; 266/202

[58] Field of Search ..... 266/80, 87, 94, 196, 266/202, 236

[56] References Cited

U.S. PATENT DOCUMENTS

| | | | |
|---|---|---|---|
| 2,873,102 | 2/1959 | Tripmacher et al. | 263/52 |
| 3,342,250 | 9/1967 | Treppschuh et al. | 164/469 |
| 4,544,404 | 10/1985 | Yolton et al. | 75/0.5 |
| 4,865,234 | 9/1989 | Folgero | 266/94 |
| 4,999,051 | 3/1991 | Yolton et al. | 266/236 |
| 5,116,027 | 5/1992 | Widdowson et al. | 266/236 |
| 5,120,352 | 6/1992 | Jackson et al. | 75/346 |

FOREIGN PATENT DOCUMENTS

| | | | |
|---|---|---|---|
| 1562646 | 5/1990 | U.S.S.R. | 266/94 |
| 1529858 | 10/1978 | United Kingdom . | |

*Primary Examiner*—George Wyszomierski

*Attorney, Agent, or Firm*—Jerome C. Squillaro; Carmen Santa Maria

[57] ABSTRACT

Apparatus for producing a metal powder includes a cooled hearth structure in which a metallic alloy is melted and a heat source above the hearth positioned to heat the melt in the hearth. The cooling of the hearth causes a protective hearth skull to form between the melt and the hearth itself. The hearth is placed within an environmental control chamber. A supply structure provides a continuous supply of the metallic alloy to the hearth structure from the exterior of the chamber. A metal powder producer is positioned to receive molten metal from the hearth, and a continuous stream of the molten alloy from the hearth is transferred to the metal powder producer. The transfer is accomplished by tipping the hearth or by teeming through an opening in the bottom of the hearth. The hearth structure can utilize two individual hearths, controllably arranged so that molten metal is drawn from one hearth while the other is recharged.

15 Claims, 9 Drawing Sheets

FIG. 7
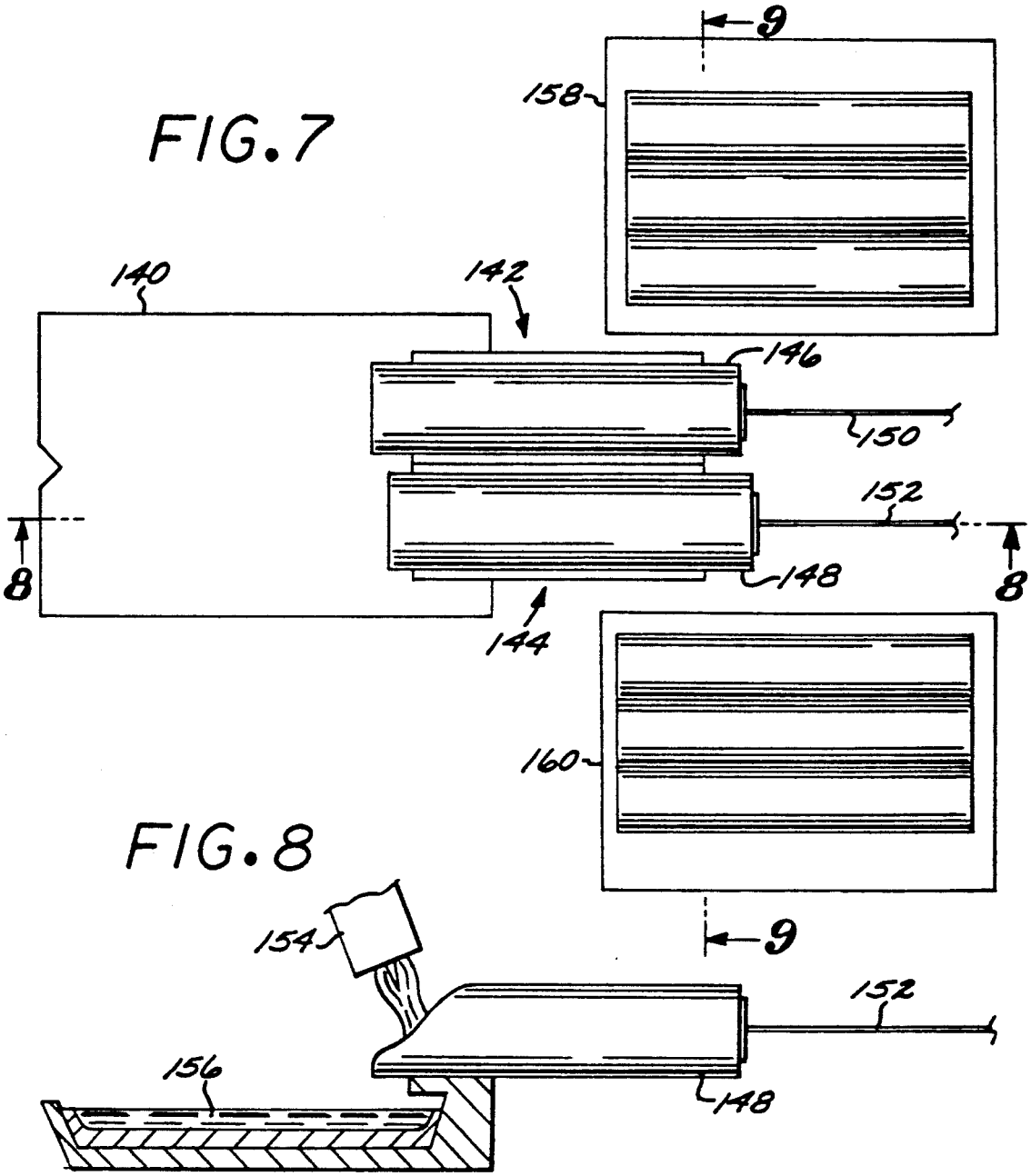
FIG. 8
FIG. 9
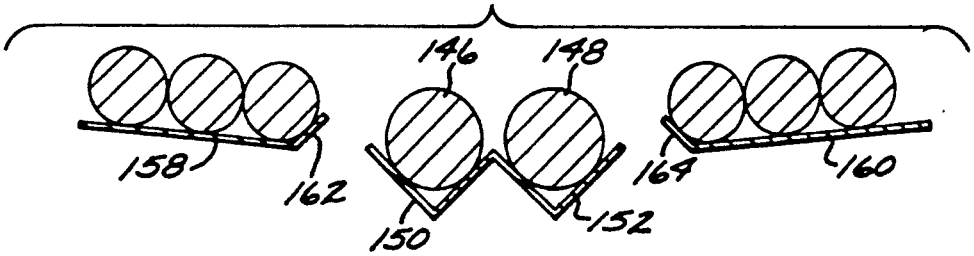

APPARATUS FOR MAKING ALLOY POWER

This application is a continuation-in-part of application Ser. No. 07/549,669, filed Jul. 6, 1990, which is a continuation of application Ser. No. 07/420,706, filed Oct. 11, 1989, which is a continuation of application Ser. No. 07/287,673, filed Dec. 20, 1988, which is a continuation of application Ser. No. 07/150,477, filed Jan. 28, 1988, which is a continuation of application Ser. No. 06/738,495, filed May 28, 1985, which is a continuation of application Ser. No. 06/507,255, filed Jun. 23, 1983, all abandoned.

BACKGROUND OF THE INVENTION

1. This invention relates to the manufacture of alloy powder, and, more particularly, to the manufacture of superalloy or titanium alloy powders characterized by reduced amounts of impurities.

2. Description of the Prior Art

A wide variety of alloy powder manufacturing methods and apparatus are well known in the metallurgical art. As such manufacture relates to high temperature alloys and superalloys, for example the type based on Fe, Co, Ni, Ti or their combinations, current powder production methods include first melting the alloy elements in a high vacuum furnace chamber through use of vacuum electron beam, vacuum arc, vacuum induction or inert gas plasma melting to produce an ingot. After production of the alloy ingot, current powder production techniques convert the alloy ingot into powder by such methods as gas atomization, rotary atomization and vacuum atomization utilizing ceramic, graphite, or refractory hearth primary melting in conjunction with a ceramic, graphite, or refractory tundish and nozzle for producing a liquid metal stream needed to produce powder.

Certain high temperature operating and highly stressed components of gas turbine engines, for example, turbine disks, use powder metal in their manufacture. By producing a powder metal preform nearly to the final shape of the component, manufacturing costs can be reduced. Alternatively, an intermediate shape can be produced and then later processed to the final form. Alloys produced by powder metallurgical techniques exhibit a uniform microstructure and minimal chemical segregation, yielding a consistent product with a high degree of workability. However, it has been recognized that inadequate powder cleanliness, particularly from ceramic particles introduced in currently used powder manufacturing processes, can result in a significant reduction in mechanical properties such as low cycle fatigue in the finished component. This reduction is due to the presence in the consolidated powder metal disks of inclusions which act as initiation sites for low cycle fatigue failures. Nearly all superalloy powder metal for such applications currently is produced by first providing an ingot, melting the ingot and then making powder by gas atomization processes. Such atomization processes utilize ceramic melting and pouring devices, and it has been found that these devices introduce a significant proportion of the undesirable ceramic inclusions. It should be recognized that the present invention can be particularly useful when the starting materials are relatively free of such ceramic inclusions.

SUMMARY OF THE INVENTION

It is a principal object of the present invention to provide an improved method for making an alloy powder in which the melting is conducted without contact with ceramic members and powder is made directly from the molten alloy.

Another object is to provide apparatus for producing an alloy powder, improved through a means to melt the metallic materials of the alloy without contacting ceramic members.

Another object is to provide such apparatus capable of continuously feeding a powder producer.

Another object is to ensure that the stream of molten metal flowing to the powder producer is well defined and controlled.

These and other objects and advantages will be more clearly understood from the following detailed description of the preferred embodiments and the drawings, all of which are intended to be typical of rather than in any way limiting the scope of the present invention.

In brief summary, apparatus for producing a metal powder comprises a cooled hearth in which a metallic alloy may be continuously melted to form a melt of the metallic alloy, a heat source such as a plasma torch positioned above the hearth to melt the charge material and to heat the charge in the hearth, and an environmental control chamber around the hearth. Means for providing a continuous supply of the metallic alloy to the hearth is provided, and such means may include at least one air lock through the chamber wall. One favored approach to providing a continuous supply of molten metal is to provide two hearths which can be alternately loaded from the apparatus exterior through the air lock and into the environmental control chamber, with molten metal drawn from one as the other is charged. Another approach permits a single hearth to be resupplied with charge material as needed.

A metal powder producer is positioned to receive molten metal from the hearth or hearths, and there is a means for transferring a stream of the molten alloy from the hearth or hearths to the metal powder producer. The means for transferring can involve overflow from the hearth, tilt pouring of the hearth, or an opening through the bottom of the hearth that controllably permits the teeming of a stream of the molten metal from the hearth. In one approach, the hearths each tilt feed a trough, and the opening is in the bottom of the trough. The amount of the molten alloy flowing to the metal powder producer is controlled by a means for regulating the flow rate of the molten alloy from the hearths or from the trough. The stream of molten metal is desirably confined as it falls through free space, and may be aided by a gas jet, an electrostatic confinement field, or a magnetic confinement field.

The present approach therefore permits the continuous operation of a metal powder producer from a well-defined stream of the molten metal.

BRIEF DESCRIPTION OF THE DRAWINGS

FIG. 7 is a plan view of the interior of another continuous powder production apparatus;

FIG. 8 is a sectional view of the apparatus of FIG. 7, taken along lines 8—8;

FIG. 9 is a sectional view of the apparatus of FIG. 7, taken along lines 9—9;

DESCRIPTION OF THE PREFERRED EMBODIMENTS

Figure 1:
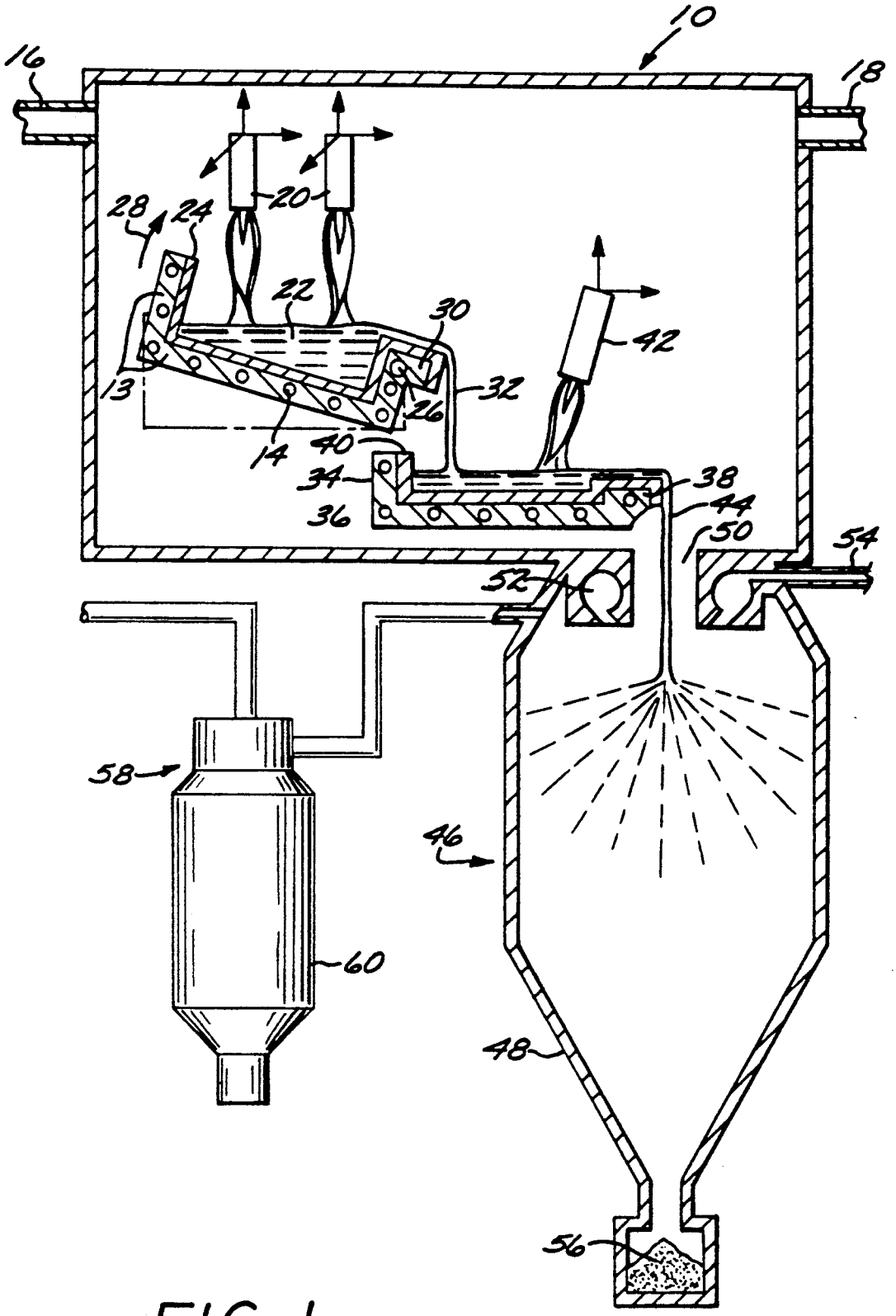
FIG. 1 is a partially sectional, diagrammatic view of one form of the present invention including an improved melt chamber and a metallic powder producer.

The development of modern aircraft gas turbine engines has defined requirements for higher temperature operating materials capable of withstanding high stresses. The complexity of component design and the advances in powder metallurgy processing and alloy definition have made the use of powder metal attractive from an economic manufacturing viewpoint. In addition, powder alloy use has the capability of achieving desirable properties such as low cycle fatigue resistance along with high temperature operating capability.

Typical of such a component requiring very high strength, high temperature materials are rotating disks used in the turbine section of modern gas turbine engines. Other engine components made of Ti-base alloys are used in the compressor section. In order to achieve desirable low cycle fatigue capability, it has been recognized that certain types of impurities must be eliminated from the powder alloy used in such components.

It has been observed that a major impurity which results in defects in such disks is ceramic in nature and can be traced to initial starting material or the subsequent processing required to produce powder from the alloy. The presence of such defects can reduce the low cycle fatigue capability of such disks below the inherent alloy capability, or in some cases below that required for high temperature and high stress conditions.

For the production of powder metal from titanium alloys, for example the titanium aluminides, or superalloys, for example of the type based on Fe, Co, Ni or their combinations, gas atomization processes are used with ceramic melting and pouring devices. Such ceramic structures introduce a significant portion of the ceramic impurity material which constitutes defects serving as low cycle fatigue fracture initiation sites in the finished component manufactured by powder metallurgy techniques.

The present invention avoids contact between ceramic members and the alloy from which the powder is manufactured, by melting metallic material out of contact with ceramic members and introducing that molten alloy into a powder metal producer. In one form, this is accomplished by the combination of the use of a fluid-cooled melting hearth and a plasma heat source which may be movable, in the melt chamber or melting apparatus in which the materials of the alloy are melted prior to introduction to a powder metal producer. The fluid-cooled hearth maintains solidified material in the hearth about the walls of the hearth. This forms a hearth skull of metallic material as a barrier between material of the hearth and the molten alloy remaining in the hearth skull.

Use of a movable plasma heat source, such as one or more movable plasma torches which together define the plasma heat source, provides rapid and uniform heating and melting of the materials defining the composition of the alloy to be made into powder. In addition, superheating of the molten material to a temperature sufficient and practical for introduction into a metal powder producer can be assisted through the use of such movable, primary plasma heat sources which are adapted to sweep over a surface of the metallic material in the hearth.

One form of the apparatus of the present invention is shown in FIG. 1. The improved means to melt the metallic material in a melting chamber 10 includes a fluid-cooled hearth 12 with walls 13 having fluid-cooling passages 14 therein connected with a source of cooling fluid such as water (not shown). As used herein, the term "wall" or "walls" may include the base or floor as well as the side walls, as desired, of the member being described. The melting chamber 10 can be adapted to enclose a desired atmosphere or pressure condition for example by introducing an inert gas such as argon into an inlet 16, to be evacuated through gas outlet 18. Appropriate other means to control the atmosphere within melt chamber 10 will be recognized by those skilled in the art, according to a variety of methods currently used. Disposed above hearth 12 is a plasma heat source 20 shown in the drawing as a plurality of plasma torches, which may be movable, directed toward hearth 12. With metallic material 22 introduced in the hearth 12, plasma heat source 20 is adapted to initiate and further the melting of such materials. When movable, plasma heat source 20 is adapted to sweep over a surface of the metallic material and to provide substantially uniform heat to such material.

During the operation of the above-described improved melting means, metallic material 22, which defines an alloy composition, is disposed in hearth 12. Such introduction can be in a batch-type process or can be in a continuous or semi-continuous process employing a supplementary metal feed system.

With cooling fluid such as water circulating within cooling passages 14, plasma heat source 20 such as the battery of movable plasma heat torches is placed in operation. In this embodiment, the torches are moved to sweep a surface of the material 22 in hearth 12 to melt such material. As molten material contacts the cooled inner wall of hearth 12, such material resolidifies into a hearth skull 24 which acts as a barrier or buffer between the hearth walls and other melted material and alloy in the hearth. In this way, the material used in hearth construction is prevented from being introduced into the molten alloy within the hearth and a reservoir of molten alloy is provided substantially free of foreign materials.

After a desirable level of melting and superheat is achieved, the hearth is tipped such as about pivot 26 using a tipping means or mechanism represented by arrow 28. Molten alloy in the hearth, remaining from that material which was resolidified to form the skull 24, is discharged or poured from the hearth, conveniently from a hearth lip 30 to provide a molten metal stream 32. (Alternatively, and as will be discussed subsequently in more detail, the molten alloy may flow from the hearth 12 by direct overflow or through an opening in the bottom of the hearth.) In the drawing, according to one form of the present invention, the molten metal stream 32 is poured into a stream control device in the form of a fluid-cooled trough 34 for supplemental handling. However, it should be understood that molten metal stream 32 can be introduced into any of several other stream control devices of a type apparent to those skilled in the art, or directly into a powder metal producer.

In the form of the invention shown in FIG. 1, molten metal stream 32 is introduced into a stream control device comprising fluid-cooled trough 34 which includes fluid-cooling passages 36 supplied from a cooling fluid source such as water (not shown) in a manner well known in the art. Similar to the hearth 12, the trough 34 can include a lip 38 to assist flow of molten metal from the trough 34.

In operation, the trough 34 receives molten alloy from the stream 32 from the hearth 12 while cooling fluid is circulated through the cooling passages 36. As the molten metal contacts the cooled walls of the trough, a portion of the molten metal solidifies forming a trough skull 40 similar to the hearth skull 34. The trough skull 40 functions in the same manner as the hearth skull 34, as a barrier or buffer between the walls of the trough and the molten alloy maintained in the trough after solidification of the trough skull 40. To maintain such additional alloy in the trough in the molten state, a secondary plasma heat source such as shown in the drawing as a plasma heat torch 42 may be desired or required. During operation, the secondary plasma heat source 42 is directed at the additional molten alloy in the trough 34 remaining from that which has resolidified as the trough skull 40. A stream 44 of molten alloy flows from trough 34 into a powder metal producer shown generally at 46 in the drawing. (Alternatively, the trough 34 can be made to tilt, or the flow of metal can be from an opening in the bottom of the trough.)

Such a metal powder producer 46 can be of a variety of types well known in the art, for example atomization or other disintegration type devices which produce metal powders. FIG. 1 shows diagrammatically one of the gas atomization type which includes a cooling tower 48 having a molten metal inlet 50 about which is disposed an atomizing gas spray means 52 to inject atomizing gas such as argon, nitrogen, helium etc., into the molten metal stream 44 entering the cooling tower 48 through the inlet 50. Such an atomizing gas is fed through a conduit 54 from a pressurized gas source (not shown). The atomizing gas thus introduced into the molten alloy stream causes the stream to disperse into small particles which solidify and fall to the bottom of the cooling tower 48 to be collected in a metal powder collector 56. As shown in FIG. 1, it is convenient to include with such a powder metal producer an exhaust system shown at 58. Generally, the exhaust system includes a fines or dust collector 60, for example of the cyclone collector type well known in the art.

If desired, supplemental heat sources can be used in melting chamber 10, for example directed at hearth lip 30 or at trough lip 38, or both. This can assist molten alloy streams such as 32 and 44 to pour in a desired molten condition or superheat.

In one example of the use of the improved melt chamber or means to melt the metallic material of the present invention, a nickel-base superalloy commercially available as Rene 95 alloy and having a nominal composition, by weight, of 0.06% C, 13% Cr, 8% Co, 3.5% Mo, 3.5% Cb, 0.05% Zr, 2.5% Ti, 3.5% Al, 0.01% B, 3.5% W with the balance Ni and incidental impurities is used. Three plasma heat torches as the primary heat source 20 are focused on a water-cooled copper melting hearth 12. An additional plasma heat torch as a secondary plasma heat source 42 can be focused on a water-cooled copper pouring trough 34, as shown in the drawing. In other cases, fewer than three torches are used. The hearth heating torches, as the primary plasma heat source, are movable in three orthogonal directions; the pouring trough heating torch or secondary plasma heat source is movable in the vertical and one horizontal direction. The sides of the apparatus and the supports for the plasma torches are protected by heat shields. As a result of several trial evaluations, it was found that the combination of a fluid-cooled hearth and a plasma heat source, which may be movable, alone or in combination with a pouring trough as a stream control device, can provide an improved means to melt a metallic material for the purpose of producing a powder metal and without a substantial increase of ceramic impurities which can act as defect sites.

With the batch-process apparatus of FIG. 1, the maximum amount of metal powder that can be produced is limited by the size of the hearth 12 and the power throughput of the plasma heat source 20. With available batch equipment having no continuous feed capability, the maximum amount of powder that can be produced is on the order of 5,000–6,000 pounds. It would, however, be desirable to produce larger amounts of metal powder continuously and without interruption.

Figure 2:
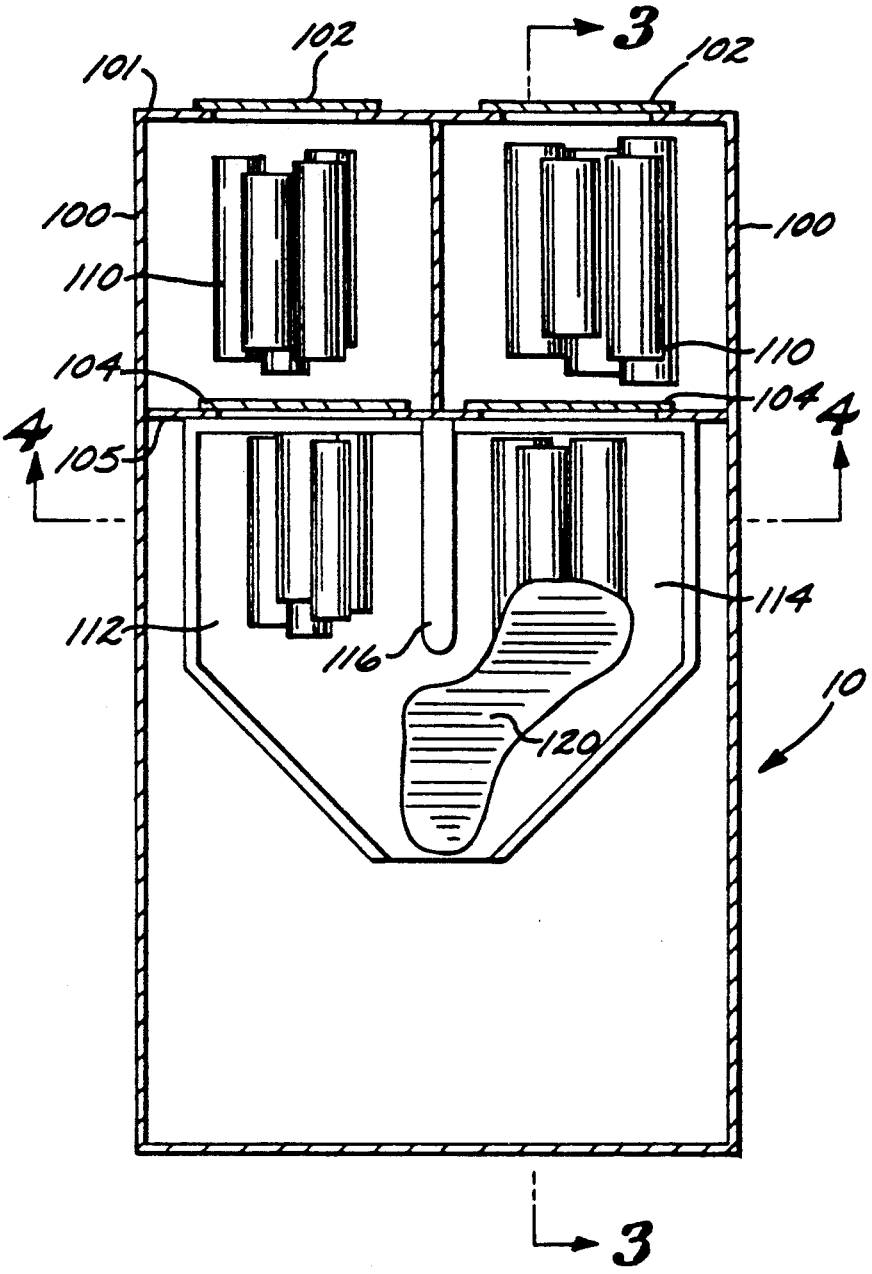
FIG. 2 is a plan view of the interior of a continuous powder production apparatus.
Figure 3:
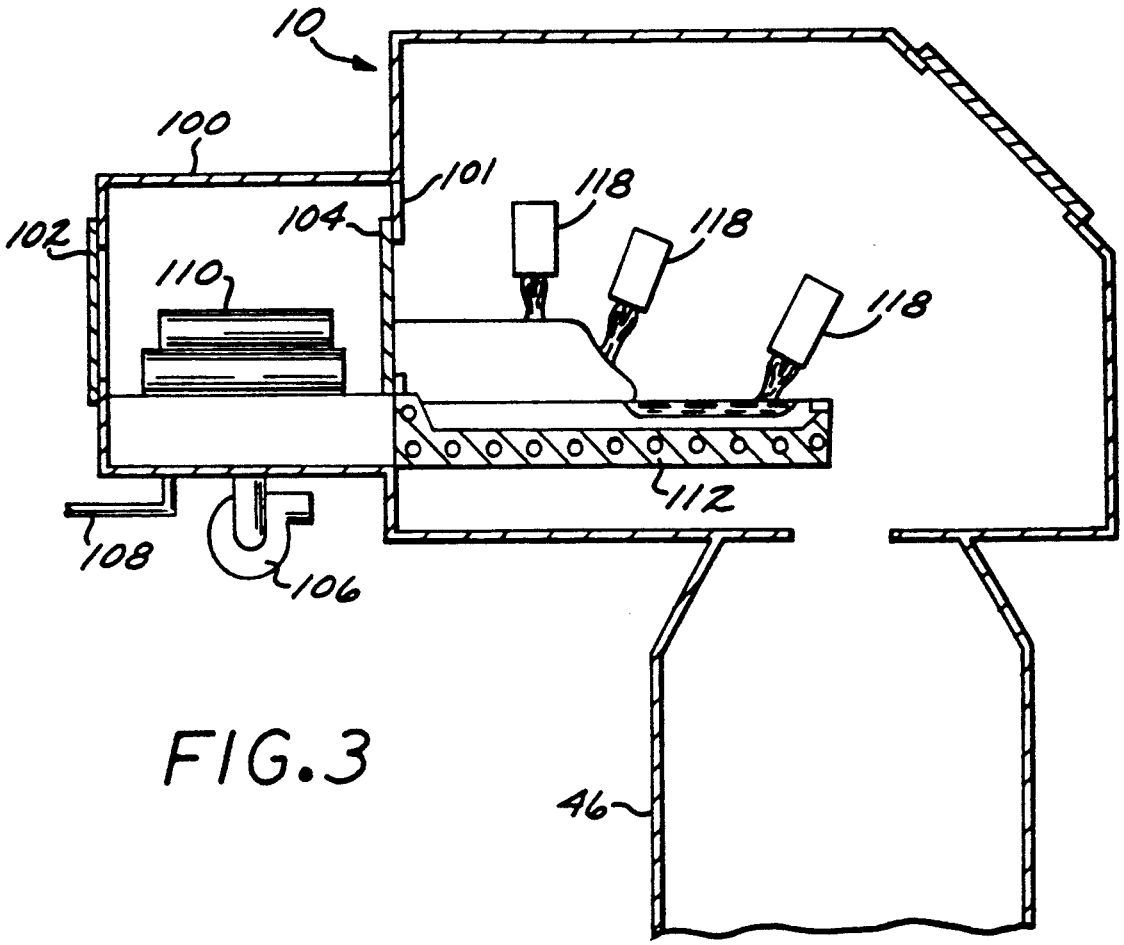
FIG. 3 is a sectional view of the apparatus of FIG. 2, taken along lines 3—3.
Figure 4:
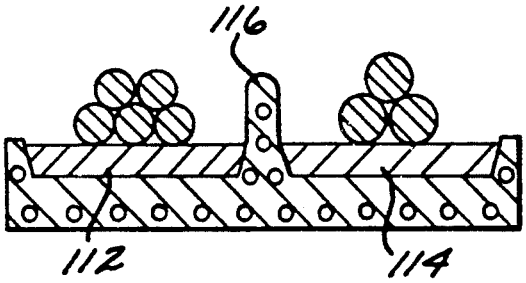
FIG. 4 is a sectional view of the hearth arrangement of the apparatus of FIG. 2, taken along lines 4—4.

Any of several means for providing a continuous supply of the metallic alloy to the hearth can be used, and one approach is illustrated in FIGS. 2–4. The melt chamber 10 and the metal powder producer 46 are generally as discussed and depicted previously, except that several operable variations will be discussed. For example, in the embodiment of FIGS. 2–4, a non-tilting, overflow type of melting arrangement is used in the hearths. An air lock 100 is provided between the exterior of the apparatus and the chamber 10 through a chamber wall 105. The air lock 100 is an enclosure having an outer door 102 from the exterior of the apparatus to the interior of the air lock 100, and an inner door 104 from the interior of the air lock 100 through chamber wall 105 to the interior of the chamber 10. A pump 106 controllably evacuates the interior of the air lock 100 when the doors 102 and 104 are closed, and a backfill line 108 provides from a source (not shown) a supply of a nonreactive gas such as argon to restore a pressure within the air lock 100 after evacuation. To use the air lock 100, the outer door 102 is opened (with the inner door 104 closed), and pieces of the metallic alloy, preferably in the form of ingots, to be melted and processed into powder, indicated at numeral 110, are placed into the interior of the air lock 100 through the open door 102. The outer door 102 is closed, and the pump 106 operated to evacuate the interior of the air lock 100. After a sufficiently reduced pressure is reached, the backfill line is operated to refill the air lock 100 with backfill gas. The inner door 104 is then opened, and the pieces 110 are moved into the interior of the chamber 10.

Continuous operation of the powder producer 46 is accomplished by providing two hearths 112 and 114. The hearths 112 and 114 are placed side by side, with the same water cooled construction described previously except that a water cooled barrier 116 (FIG. 4) is placed between the hearths 112 and 114. Two separate air locks 100 are provided, one for each of the hearths 112 and 114 as shown in FIG. 2, although a single larger air lock would be operable. In any event, it must be possible to replenish the metal pieces in each hearth 112 and 114 through the single or double air lock(s).

In operation, the metal charge in one of the hearths 112 or 114 is progressively melted by a suitable heating source, in this case at least one plasma torch 118, forming a melt pool 120. (For illustrative purposes, the charge in hearth 114 is shown as being melted in FIG. 2.) The melt in the pool 120 flows over the lip of the hearth 114 and down into the powder producer 46. When the charge in the hearth 114 is nearly exhausted, the torch 118 is redirected to the charge in the other hearth, here the hearth 112, progressively melting it in a similar manner. While the charge in hearth 112 is being melted, the air lock 100 for hearth 114 is operated in the manner described previously to load new pieces of alloy into the out-of-service hearth 114. When the charge in the hearth 112 is nearly exhausted, the heating source is redirected back to the hearth 114, the hearth 112 is reloaded, and the cycle repeats.

The hearth structure 112, 114, 116 shown in FIGS. 2–4 can be stationary as shown, or can be provided with a tilting arrangement such as illustrated by the pivot, numeral 28, in FIG. 1.

Figure 5:
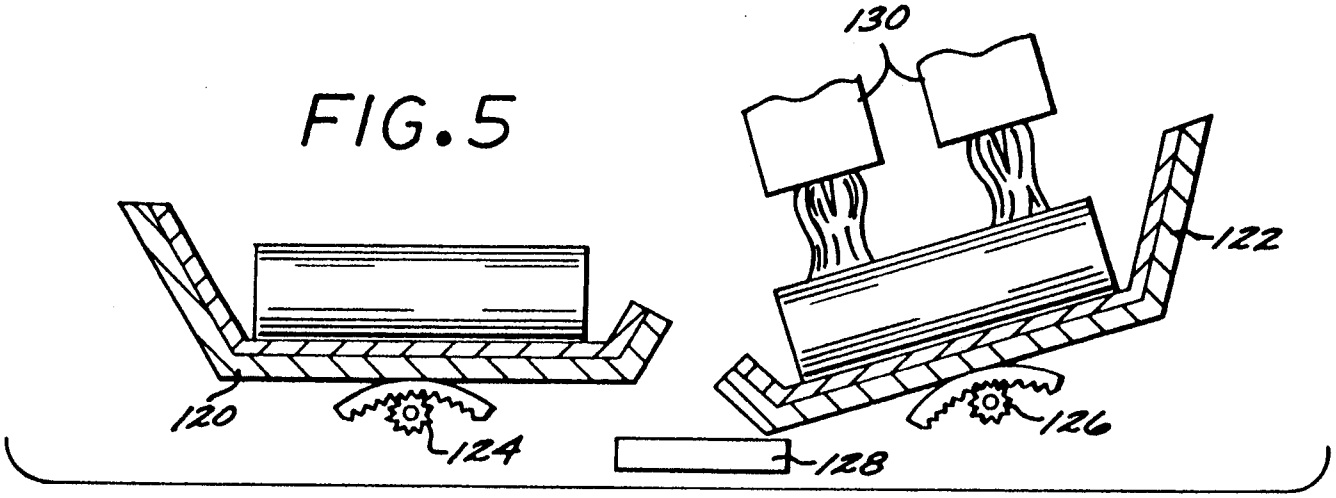
FIG. 5 is an interior side elevational view of another continuous powder production apparatus.
Figure 6:
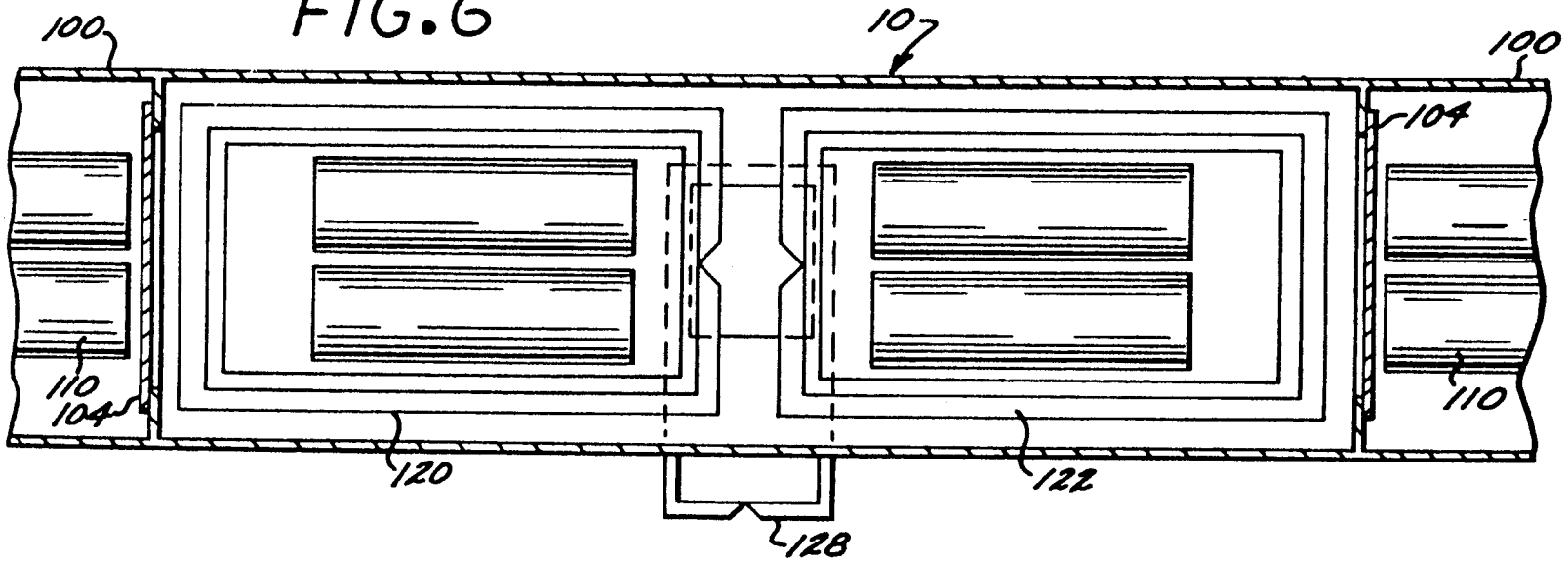
FIG. 6 is an interior plan view of the apparatus of FIG. 5.

Another continuous production configuration is illustrated in FIGS. 5 and 6. This unit is operated in a chamber like the chamber 10, and with any suitable powder production apparatus like that of the apparatus 46. Two water-cooled hearths 120 and 122 are provided, and in this embodiment the hearths 120 and 122 are each mounted on a pivoting structure, numerals 124 and 126, respectively. The hearths 120 and 122 are positioned on either side of a pouring trough 128.

In operation, the charge in one of the hearths, here the hearth 122, is melted by a heat source such as one or more plasma torches 130, and the resulting molten metal is poured into the trough 128 by gradually tilting the hearth. The molten metal then flows from the trough 128 as a stream into the powder producer 46. The advantage of using an intermediate trough 128, rather than pouring directly from the hearth into the powder producer, is that the trough acts as a buffer to smooth out irregularities in the rate of pouring from the hearths, and also ensures that the stream 44 will be precisely positioned over the proper location of the powder producer 46. If the molten metal were poured directly from a tilted hearth into the powder producer, the location of the stream of molten metal would move as pouring progressed, unless a specialized pouring linkage were used. The flow of metal from the trough 128 into the powder producer 46 can be over the lip of the trough 128 as illustrated, or through an opening in the bottom of the trough 128 as will be discussed in greater detail subsequently.

During operation, each of the troughs 120 and 122 is alternately supplied with fresh metal pieces 110 from its respective air lock 100 in a manner similar to that described previously in respect to the embodiment of FIGS. 2–4. In the approach of FIGS. 5–6, however, the air locks 100 are on opposite sides of the chamber 10, to permit direct access to each of the hearths 120 and 122 without interfering with the operation of the other hearth.

FIGS. 7–9 illustrate another approach to providing a continuous powder production capability. Here, a single water-cooled hearth 140 is operated within a chamber in conjunction with a powder producer as shown in FIG. 1. Metal alloy is supplied directly to the hearth 140 by two sources 142 and 144, which are alternately operated. In the preferred embodiment of this approach, the metal alloy is in the form of ingots 146 and 148, which are alternately and progressively pushed into the hearth 140 by a metal feed system, shown as pusher mechanisms 150 and 152, respectively. However, any feed mechanism may be used. The ingot 146 or 148 currently being pushed is melted by a heating source, such as a plasma torch 154, forming a melt pool 156 that falls as a stream into the powder producer 46. The hearth 140 may be of the overflow type as shown, or of the tiling or bottom-pour types.

When an ingot 146 or 148 being pushed and melted is nearly fully melted, the heat source 154 is directed to the other ingot. The respective pusher mechanism 150 or 152 withdraws, permitting another ingot to be loaded into the pusher mechanism. A convenient approach for providing additional ingots into each mechanism is a pair of magazines 158, 160 loaded with ingots, one for each pusher mechanism 150, 152. Each magazine 158, 160 has a release gate 162, 164, respectively, that is remotely operated to permit an ingot to roll from the magazine into the pusher mechanism. The apparatus of FIGS. 7–9 may be operated in a semi-continuous fashion in which the process is not operated indefinitely but for some predetermined length of run, by providing sufficient material for the run in the magazines 158, 160. No air lock mechanism is needed. Alternatively, the apparatus may be run indefinitely by providing an air lock system similar to that of FIGS. 2–6, to add new ingots to the metal feed system.

Figure 10:
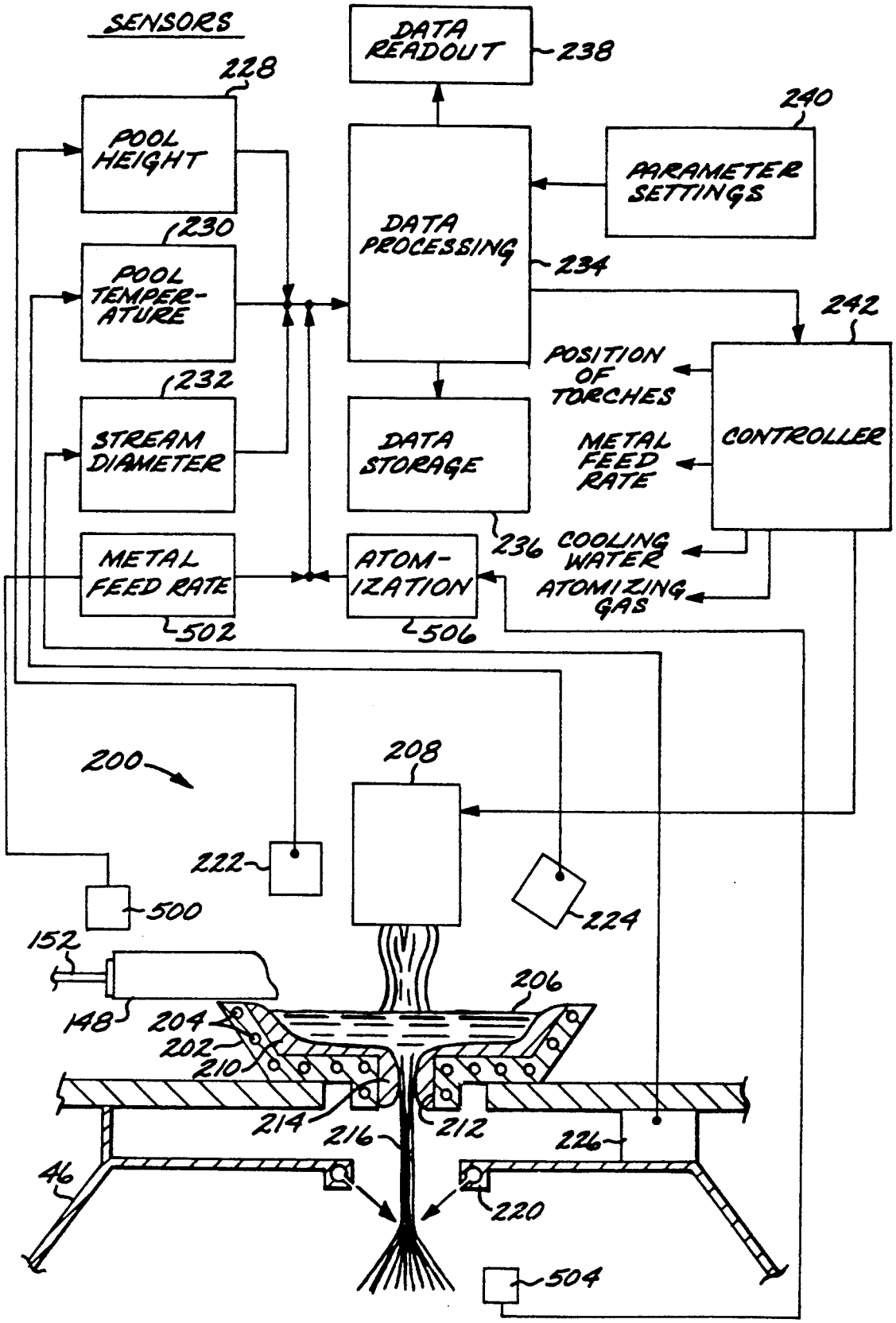
FIG. 10 is a schematic diagram of a bottom-pour vessel and feedback controller.

When a powder production apparatus is operated continuously or semi-continuously for extended periods of time, an automated control system is particularly valuable to ensure uniform quality of the product. The control system permits systematic determination of the best operating conditions, as well as the maintenance of those operating conditions throughout the production run. An automated control system 200 is illustrated in FIG. 10 in conjunction with a water-cooled bottom pour vessel 202, which may be either a melting hearth or a pouring trough as discussed previously. A similar automated control system 200 may be used with hearths or troughs wherein the stream is formed by overflow over the lip of the hearth or trough. The bottom-pour vessel avoids the introduction of floating surface oxides into the melt stream and is capable of fully reproducible operation.

The bottom-pour vessel 202 is similar in construction to the hearths and troughs discussed previously, and is enclosed within an environmental control chamber such as described previously, but not shown in FIG. 10.

Air locks and other structure to permit continuous or semi-continuous operation may be provided, as discussed previously. The vessel 202 is constructed of a conductive metal such as copper, with water cooling channels 204 running therethrough. A molten pool of the metal 206 to be made into powder is formed in the vessel 202 by heating from above, preferably with a plasma torch 208. The heat extraction from the sides and bottom of the pool of metal 206 through the walls of the vessel 202 causes a skull 210 to form. Thus, the pool of metal 206 is contained within its own composition of solid metal, and does not become contaminated during extended runs, even though some of the skull may melt.

An opening 212 is provided through the bottom of the vessel 202. The skull 210 extends down the interior sides of the opening 212, forming a plug 214 that completely closes the opening in most circumstances. As depicted in FIG. 10, the opening 212 may be opened by partially melting the plug 214, so that molten metal can run through the opening 212 to form a stream 216. To melt the plug 214 in whole or in part, additional heat is applied by increasing the heat input from the overhead plasma torch 208 and reducing the heat input once breakthrough is achieved to reach a steady state shape and profile of the skull 210. If the heat input capability of the overhead plasma torch 208 is insufficient to melt through the plug, additional heat may be applied to the plug 214 from other heating sources.

The stream 216 falls downwardly into the powder producer 46. The stream 216 is atomized into small particles that rapidly cool by any known approach, such as an illustrated stream of inert gas directed inwardly through holes in a plenum 220. The resulting powder falls to the bottom of the powder producer 46 where it is collected and graded. Powder of unsuitable sizes is recycled into the melting operation.

To ensure high yield of the final product, the lateral position, cross sectional shape, and volume flow rate of the metal in the stream 216 must remain as uniform as possible at some preselected combination of values. It will be appreciated that maintaining these parameters constant is difficult because of processing variations that occur over time. Seemingly minor fluctuations in cooling water pressure and flow, power levels to the plasma torches 208, and temperature of the molten pool 206 (due to adding new material to the molten pool, causing it to momentarily cool) can disrupt the delicate balance of heat flows into and out of the vessel 202. The size of the plug 214 may consequently vary, causing a fluctuation in the diameter of the stream 216. Overcontrolling the system to reattain equilibrium may lead to fluctuations of increasing magnitude and reduced powder production efficiency, or, ultimately, a system failure.

A control system 200 like that illustrated schematically in FIG. 10 is therefore important in maintaining the successful operation of the powder production system. In general terms, the control system 200 measures operating characteristics of the powder production apparatus, and controls the power input and possibly other controllable parameters of the apparatus.

In the preferred embodiment, operating characteristics are measured by appropriate sensors. The height position of the surface of the pool 206 is measured by a height sensor 222. The height of the pool is important, because the hydrostatic pressure of the metal in the pool changes the pressure on the metal as it flows through the opening 212. The temperature of the surface of the molten pool 206 is measured by a temperature sensor 224. Alternatively, the temperature of the stream 216 or other temperatures within the system could be measured. The temperature of the molten pool 206 is important because it indicates whether the heat balance in the pool is changing. The diameter of the stream 216 is measured by a diameter sensor 226. The diameter of the stream is important because changes in the diameter alter the performance of the atomization device. While stream diameter is the operating characteristic of most direct interest, height of the pool and temperature are measured because fluctuations in these values give initial warnings of fluctuations that cause the diameter to vary thereafter.

The feed rate of metal alloy into the hearth is monitored by an input metal feed rate sensor 500. This feed rate is important because the amount of metal alloy in the hearth or added to the hearth can affect the heat balance of the pool. A higher feed rate requires more heat input to maintain a preselected temperature and a correspondingly lower feed rate requires less heat input.

An atomization sensor 504 detects the rate of molten metal being atomized into powder. The atomization rate is important because it indicates the amount of powder being produced. As this amount changes, the flow and pressure of atomization gas must be adjusted to account for the change in molten metal flow.

The outputs of the sensors 222, 224, 226, 500 and 504 are supplied to respective sensor drivers 228, 230, 232, 502 and 506 which are commercially available. The drivers provide appropriate power inputs to the sensors, and condition the output signals to acceptable levels.

In a preferred embodiment, the height sensor 222 is a video position analyzer, which can be obtained commercially from Colorado Video as the model 635. The temperature sensor 224 is that described in U.S. Pat. Nos. 4,687,344 and 4,656,331, whose disclosures are incorporated by reference. The diameter sensor 226 is also a single modified Colorado Video model 635 video position analyzer, or a pair of such devices. In each case, the appropriate driver is also commercially available.

Outputs from the drivers 228, 230, 232, 502 and 506 are provided to a data processor 234, which is preferably a programmable microprocessor such as a Hewlett Packard HP1000. The data processor also provides for data storage 236 and data readout 238. Preselected operational settings 240 are provided to the data processor 234. The operational settings 240 are typically established by initial trials of the powder production apparatus, but may be changed with further experience. Although the operational settings will vary from system to system, in general they will require that the stream diameter, height of the pool, temperature of the pool, metal feed rate and atomization rate remain within limits. In a more sophisticated approach, minor fluctuations in a measured characteristic or function of measured characteristics can be used to predict larger fluctuations.

The data processor 234 compares the inputs from the sensors 222, 224, 226, 500 and 504 to the required parameter settings 240, and produces output commands to a controller 242. The controller 242 controls the power levels, position, and movement of the plasma torches 208. For example, if the diameter of the stream 216 begins to decrease, the power to the torches 208 can be increased to reduce the plug size and increase the stream diameter. On the other hand, if the stream diameter is reduced but the temperature of the melt remains constant, then the underlying cause may be another fluctuation, such as a change in cooling water flow. The controller 242 sends a command to the water pressure or flow controllers, and may also change the power to the torches 208. The data processor 234 and controller 242 are together programmed to recognize a variety of complex fluctuations and to provide corrective action. In addition to torch power levels and water pressure and flow, the controller can be made to act upon other parameters such as the positioning of the torches, the feed rate of metal to the melting vessel, or the pressure of the atomizing gas in the plenum 220.

Figure 11:
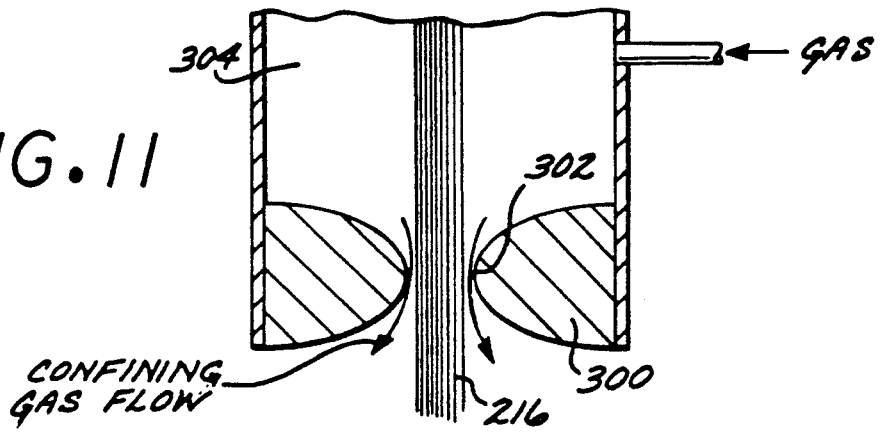
FIG. 11 is a side sectional view of a stream confinement apparatus using a confining gas envelope.

In addition to controlling the operating inputs to the melting vessel 202 in order to control the properties of the metal stream 216, the stream itself can be acted upon to confine it to a selected path and size. These techniques are used to confine the stream as it falls through free space. In one technique illustrated in FIG. 11, the stream 216 falls through a converging/diverging nozzle 300 having an aperture 302 whose diameter is greater than the desired diameter of the stream 216. The upper side of the nozzle 300 is pressurized with an inert gas in a pressurization chamber 304. The inert gas escapes through the nozzle 300 around the periphery of the aperture 302, serving to confine the stream 216 at the center of the aperture. A similar technique has been used in another application, the production of glass fibers. See U.S. Pat. No. 4,001,357, whose disclosure is incorporated by reference.

Figure 12:
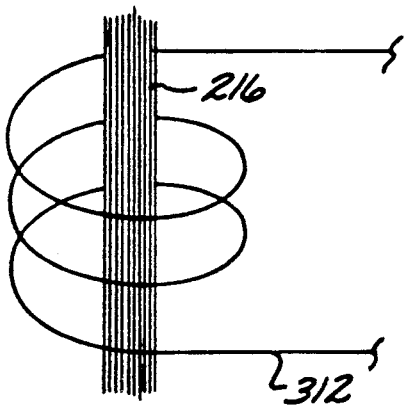
FIG. 12 is a schematic perspective view of a stream confinement apparatus using a magnetic field.

A second technique schematically illustrated in FIG. 12 is to apply a magnetic confining field to the stream 216, using the field produced by a high frequency induction coil 312.

Each of these techniques serves to confine the stream to a preselected size and path, reducing variation in powder production.

Performance of the powder producer 46 can be affected by the atomization approach utilized. One type of atomization apparatus is shown as the atomizing gas spray means 52 of FIG. 1.

Figure 13:
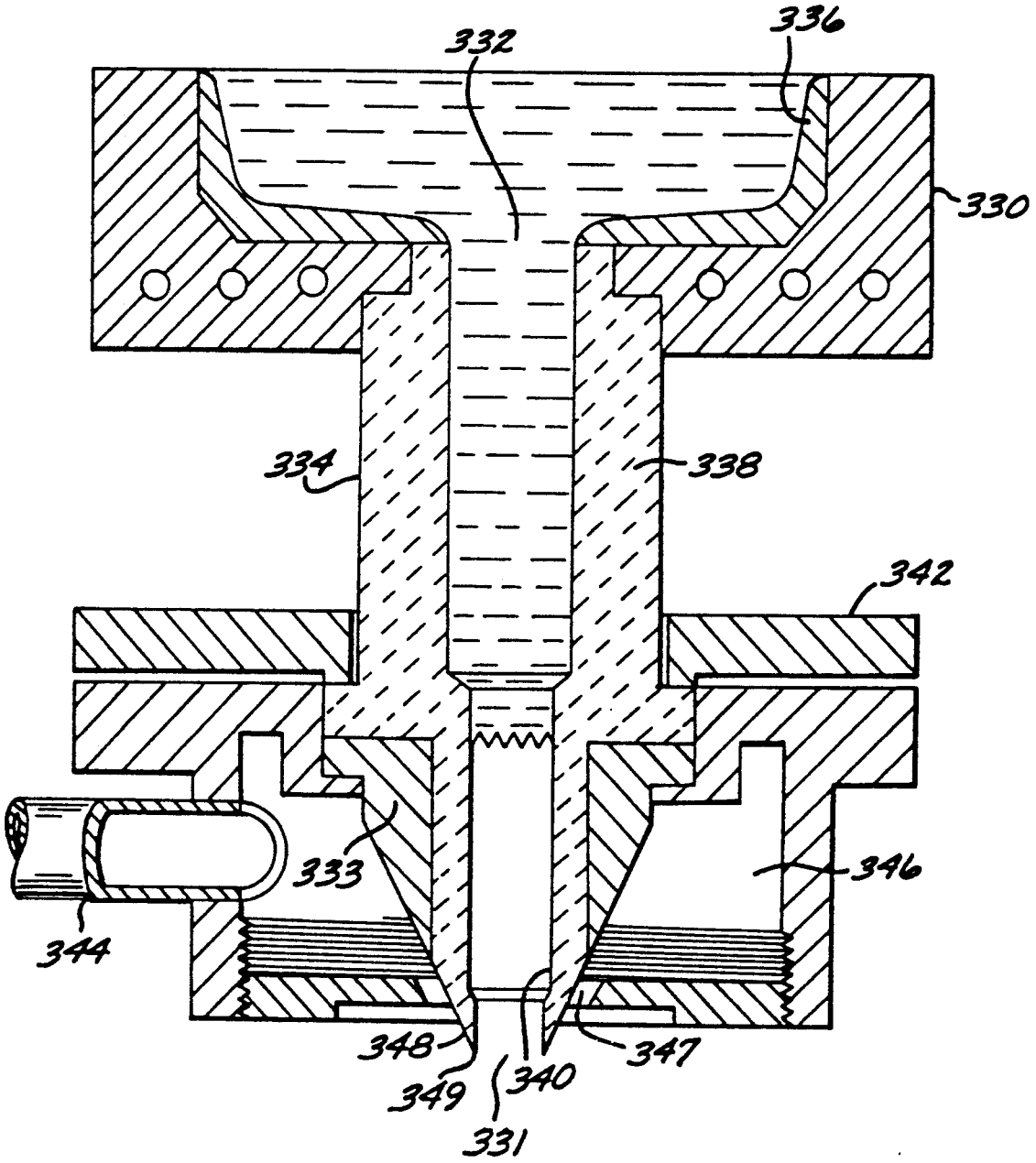
FIG. 13 is a side elevational view of a close-coupled nozzle with integral atomization gas jet attached to a melting vessel.

In another atomization approach, a close coupled or confined type atomization apparatus is illustrated in FIG. 13. A hearth 330 having the water cooled structure described previously has a bottom pouring opening 332. The molten metal flows through the opening 332 of the hearth 330, into a close-coupled nozzle assembly 334 attached to hearth 330 opening 332. Nozzle assembly 334 includes melt guide tube 338. Guide tube 338 may be integral with the nozzle assembly as shown in FIG. 13, or may be a separate part of nozzle assembly 334. Nozzle assembly 334 having an integral guide tube 338 is constructed of a ceramic material, although a water-cooled metallic material may also be used. When guide tube 338 is a ceramic, metal skull 336 may form over a portion of guide tube 338 as shown in FIG. 13. Although contact of molten metal with ceramic is generally undesirable in the present invention, a ceramic guide tube is considered to be a small factor in cleanliness control and is superior to alternate materials. When nozzle assembly and guide tube are constructed of a water-cooled metallic material, skull 336 will be expected to extend downward along at least a portion of the melt guide tube inner surface 340.

Nozzle assembly 334 may be held in position below hearth 330 by hold down plate 342, although plate 342 is not critical to the operation of nozzle assembly 334.

A gas supply line 344 is assembled into plenum 346 of nozzle assembly 334 to allow gas to enter the plenum. Gas flows through plenum 346 and exits through annular gas flow orifice 347 as a stream. The gas stream then travels along melt guide tube outer surface 348 to nozzle tip 349.

Molten metal passes through the interior of melt guide tube 338 to nozzle tip 349. As molten metal alloy exits melt guide tube 338 at nozzle tip 349, the gas stream moving along melt guide tube outer surface 348 toward nozzle tip 349 impinges upon the exiting molten metal alloy, forming an atomization region 331 immediately below nozzle assembly 334 and forming metal powder, which may be collected in the powder producer bottom, not shown. This technique avoids the need for metal stream control after the stream falls free of the hearth 330, because atomization occurs immediately as the metal alloy exits nozzle assembly 334. This approach can also be used with tilting and overflow type hearths.

Nozzle assembly 334 of FIG. 13 also includes a gas shield 333 positioned between plenum 346 and melt guide tube 338 to prevent gas flowing through the plenum from excessively cooling guide tube 338, thereby stopping or inhibiting flow of molten metal through guide tube 338.

Figure 14:
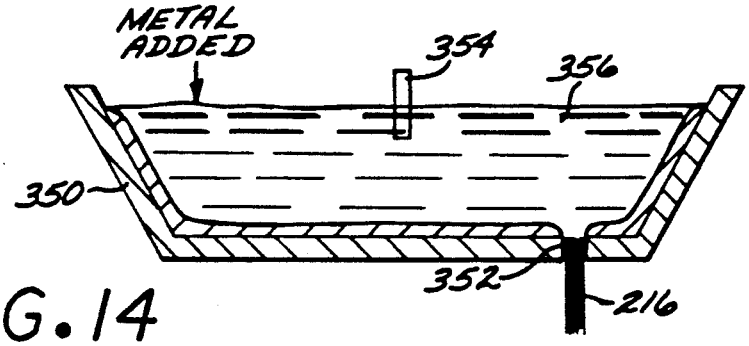
FIG. 14 is a side sectional view of a hearth with a skimmer.

A basic motivation for the present invention is to avoid the introduction of ceramic into the metal powder product. The cleanliness of the product can be even further improved by removing oxides and other particles from the molten metal to prevent them from reaching the metal stream 216. A skimming attachment is illustrated in FIG. 14. A water-cooled trough or hearth 350 has a bottom-pouring configuration with an opening 352 at one end of the bottom of the hearth. (The present approach is also operable with tilting or overflow hearths, such as refining hearths upstream of the bottom-pour trough or hearth.) A skimmer plate 354 contacts the surface of a melt 356 within the hearth 350, and extends a short distance below the surface of the melt 356. The skimmer plate may be formed of a metal with a high melting temperature, a water-cooled metal, or a piece of ceramic coated with a metal such as tungsten that has a high melting temperature. Solid metal pieces are added to the hearth 350 on the end opposite from the opening 352. When the metal pieces melt, oxide and other solid impurities float to the surface of the melt 356. The skimmer plate 354 prevents the floating material from moving past the plate 354 to the region of the opening 352. If it were permitted to move to the region of the surface of the melt above the opening 352, the normal agitation and currents within the melt might sweep some of the floating material down into the melt and through the opening 352 into the metal stream 216.

Figure 15:
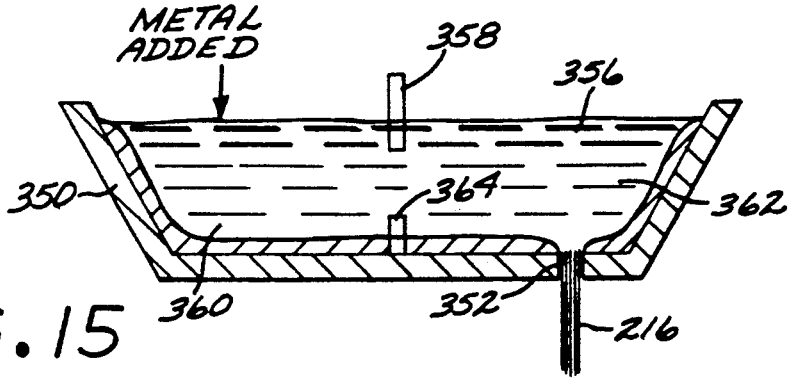
FIG. 15 is a side sectional view of a multichambered hearth.

Another embodiment is shown in FIG. 15. Here an apertured plate 358 is substituted for the skimmer plate 354. The apertured plate 358 effectively divides the hearth 350 into two separate chambers. Metal flows from a metal-addition chamber 360 to a pour chamber 362 through an aperture 364 in the plate 358. The apertured plate 358 has the advantage that it prevents floating material from reaching the pour chamber 362, prevents more solid dense material that sinks to the bottom of the metal-addition chamber 360 from moving to the pour chamber 362, and reduces convective solid transfer from the metal addition chamber 360 to the pour chamber 362.

Figure 16:
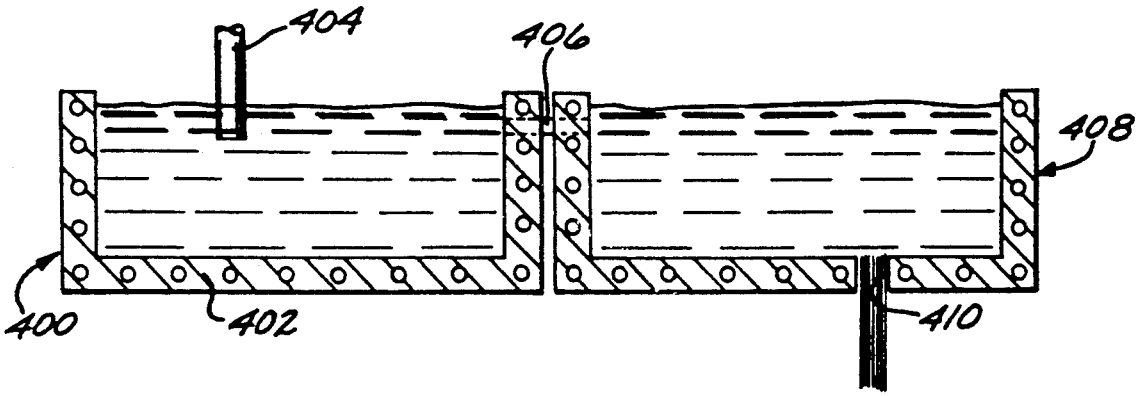
FIG. 16 is a side sectional view of two hearths arranged so that metal flows from the first hearth to the second hearth.

A further embodiment is illustrated in FIG. 16. A first hearth 400 has a water-cooled wall 402, and a skimmer plate 404 that functions in the same manner as the skimmer plate 354 of FIG. 14, to remove foreign matter having a density less than that of the molten metal. The molten metal in the first hearth 400 overflows through a notch 406 into a second hearth 408. The wall and overflow from the first hearth 400 acts in much the same manner as the lower part of the apertured plate 358 of FIG. 16, to remove foreign matter having a higher density than that of the molten metal. The molten metal is then fed through a bottom-pour opening 410 in the second hearth 408, or by tilt pouring or overflow.

Through the use of the apparatus of the present invention, there is provided an improved method for making an alloy powder, especially one of a titanium alloy such as a titanium aluminide or a high temperature alloy or superalloy such as based on Fe, Co, Ni, Ti or their mixtures, the method being characterized by the substantial avoidance of addition of defect-forming ceramic materials.

This invention has been described in connection with specific embodiments and examples. However, it will be readily recognized by those skilled in the art the various modifications and variations of which the present invention is capable without departing from its scope as represented by the appended claims.

What is claimed is:

1. Apparatus for producing metal powder, comprising:

a cooled hearth in which a metallic alloy is melted to form a melt of molten metallic alloy;

a heat source above the hearth positioned to heat and melt the alloy in the hearth;

an environmental control chamber around the hearth;

means for providing a supply of the metallic alloy to the hearth that includes at least one air lock means positioned between the exterior of the apparatus and the interior of the environmental control chamber for moving the metallic alloy from the exterior of the apparatus through a wall of the chamber to the cooled hearth;

a metal powder producer positioned to receive molten metallic alloy from the hearth; and means for transferring the molten alloy from the hearth to the metal powder producer.

2. The apparatus of claim 1, wherein the means for providing a supply of the metallic alloy to the hearth includes:

a second cooled hearth within the environmental control chamber in which the metallic alloy is melted to form a second melt;

a second heat source above the second hearth positioned to heat the metallic alloy in the second hearth; and wherein air lock means permits the supply of metallic alloy to be selectively moved to one of the cooled hearths.

3. The apparatus of claim 2, wherein the supply of metallic alloy moved from the exterior of the apparatus through airlock means to the hearths is ingots fed directly into the selected hearth.

4. The apparatus of claim 2, wherein the means for transferring the molten alloy from the hearths to the metal powder producer further includes:

a trough positioned between the hearths and the metal powder producer to receive molten metallic alloy from the hearths and to transfer molten metallic alloy to the metal powder producer;

means for selectively transferring molten metallic alloy to the trough from the hearths; and means for regulating the flow rate of molten alloy to the metal powder producer.

5. The apparatus of claim 4 wherein the trough further includes a bottom having an opening through which the molten metallic alloy is discharged.

6. The apparatus of claim 4, wherein means for regulating the flow rate of molten alloy to the metal powder producer includes means for confining a stream of molten alloy to a free space flow path, such that contact between the metal stream and the means for regulating the flow rate is avoided.

7. The apparatus of claim 1, wherein means for transferring molten alloy from the hearth to the metal powder producer includes an opening through the bottom of the hearth.

8. The apparatus of claim 1 wherein means for transferring the molten alloy includes a close-coupled nozzle having a gas stream flowing from a gas jet positioned so that the gas stream having a selectable pressure impinges upon a stream of the molten metal immediately after the molten metal stream leaves the hearth, the gas pressure selectable by means for regulating gas flow rate into the gas jet.

9. The apparatus of claim 1, wherein means for transferring the molten alloy from the hearth to the metal powder producer includes:

a nozzle having a diameter greater than an intended diameter of a stream of the molten metal alloy;

means for introducing a flow of a confinement gas into and through the nozzle around its periphery, the confinement gas acting to confine the metal stream to the center of the nozzle; and means for atomizing the molten metal stream to form a powder as the molten stream exits the nozzle by impingement with a second gas having a pressure sufficient to effect said atomizing.

10. The apparatus of claim 1, further including:

a sensor for detecting metal height in the hearth and sending signals indicative of the height;

a sensor for detecting metal temperature in the hearth and sending signals indicative of the temperature; and means for controlling the metal powder production, the means for controlling including a computer that receives sensor signals indicative of metal height and temperature in the hearth and sends command signals to the heat source in response to the received signals.

11. Apparatus for producing metal powder, comprising:

a computer that receives input from a plurality of sensors incorporated in the apparatus, analyzes the input received from each of the sensors and sends command signals based an the analysis of the received input to a plurality of control means;

a cooled hearth in which a metallic alloy is melted to form a melt of the metallic alloy, the hearth having an opening therein through which the molten metal flows;

at least one heat source above the hearth positioned to heat and melt the alloy in the hearth, the heat source being provided with control means responsive to command signals, thereby controlling the position of the heat source and the amount of heat provided therefrom;

an environmental control chamber around the hearth;

an air lock through which a supply of metallic alloy may be transferred from the exterior of the apparatus to the hearth;

a metal powder producer positioned to receive the molten alloy from the hearth, the metal powder producer including a gas jet directed toward the region through which the molten metallic alloy flows during operation of the apparatus to atomize the molten metal to a powder, the gas jet being provided with control means responsive to command signals, thereby controlling the amount of gas provided to the gas jet;

an atomization sensor to detect the rate of metal atomization;

a mechanism for feeding the metallic alloy into the hearth, the mechanism being provided with control means responsive to command signals, thereby controlling the amount of metallic alloy fed into the hearth;

an input metal feed rate sensor for monitoring the feed rate of the alloy feed mechanism;

a temperature sensor that senses the temperature of the molten alloy in the cooled hearth;

a melt level sensor that senses the height of the molten alloy in the cooled hearth; and a stream diameter sensor that senses the diameter of a stream of molten metal flowing from the hearth;

wherein the computer sends command signals to the control means such that the stream diameter is maintained at a substantially constant level.

12. The apparatus of claim 11 further including a second heat source below the hearth positioned to heat molten alloy flowing from the hearth.

13. The apparatus of claim 11, further including a second cooled hearth within the environmental control chamber.

14. The apparatus of claim 11, wherein the second cooled hearth is positioned between the metallic alloy feed mechanism and the cooled hearth to supply molten metal to the cooled hearth, the feed mechanism providing metallic alloy to the second cooled hearth for melting by the heat source.

15. The apparatus of claim 11, wherein the computer sends command signals to the control means such that the temperature, the melt level and the atomization rate are maintained at substantially constant levels.

* * * * *